US008938927B1

(12) United States Patent
Bragg

(10) Patent No.: US 8,938,927 B1
(45) Date of Patent: Jan. 27, 2015

(54) HORIZONTALLY ORIENTED INSULATED METAL PANEL SIDING SYSTEM

(71) Applicant: McElroy Metal Mill, Inc., Bossier City, LA (US)

(72) Inventor: Rick A. Bragg, Battle Creek, MI (US)

(73) Assignee: McElroy Metal Mill, Inc.

( * ) Notice: Subject to any disclaimer, the term of this patent is extended or adjusted under 35 U.S.C. 154(b) by 0 days.

(21) Appl. No.: 14/308,328

(22) Filed: Jun. 18, 2014

(51) Int. Cl.

| | |
|---|---|
| ***E04B 2/30*** | (2006.01) |
| ***E04F 13/08*** | (2006.01) |
| ***E04B 2/02*** | (2006.01) |
| ***E04F 13/24*** | (2006.01) |
| ***E04F 13/26*** | (2006.01) |
| ***E04F 13/12*** | (2006.01) |

(52) U.S. Cl.

CPC ..... *E04F 13/0862* (2013.01); *E04B 2/02* (2013.01); *E04F 13/0894* (2013.01); *E04F 13/0898* (2013.01); *E04F 13/24* (2013.01); *E04F 13/26* (2013.01); *E04F 13/12* (2013.01); *E04F 13/0878* (2013.01); *E04B 2002/0256* (2013.01); *E04B 2002/0202* (2013.01)

USPC ..... 52/483.1; 52/698; 52/710; 52/712; 52/714; 52/715

(58) Field of Classification Search

USPC ..... 52/483.1, 698, 410, 513, 699, 710, 712, 52/714, 715

See application file for complete search history.

(56) References Cited

U.S. PATENT DOCUMENTS

| | | | | | |
|---|---|---|---|---|---|
| 4,037,377 | A * | 7/1977 | Howell et al. | ..... | 52/309.9 |
| 4,123,885 | A * | 11/1978 | Scott | ..... | 52/489.1 |
| 4,184,301 | A * | 1/1980 | Anderson et al. | ..... | 52/478 |
| 4,304,083 | A * | 12/1981 | Anderson | ..... | 52/509 |
| 5,425,210 | A * | 6/1995 | Zafir | ..... | 52/404.4 |
| 5,678,369 | A * | 10/1997 | Ishikawa et al. | ..... | 52/309.9 |
| 6,253,511 | B1 * | 7/2001 | Boyer | ..... | 52/302.4 |
| 6,627,128 | B1 * | 9/2003 | Boyer | ..... | 264/46.5 |
| 6,968,659 | B2 * | 11/2005 | Boyer | ..... | 52/302.4 |
| 7,007,433 | B2 * | 3/2006 | Boyer | ..... | 52/309.9 |
| 7,748,181 | B1 * | 7/2010 | Guinn | ..... | 52/235 |
| 8,291,672 | B2 * | 10/2012 | Hohmann et al. | ..... | 52/698 |
| 8,621,810 | B2 * | 1/2014 | Manser et al. | ..... | 52/506.05 |
| 8,813,451 | B2 * | 8/2014 | Foral | ..... | 52/478 |

(Continued)

OTHER PUBLICATIONS

Centria, *Versawall* (http://www.centriaperformance.com/products/wall/industrial_commercial_insulated_metal_panels/versawall/2/2_30.aspx).

Green Span Profiles, *Infinity Technical Data Sheet*.

(Continued)

*Primary Examiner* — Mark Wendell

(74) *Attorney, Agent, or Firm* — Keith B. Willhelm

(57) ABSTRACT

Insulated metal panel siding system for a structure comprising elongated base members and elongated insulated metal panels. The base member is installed along the base of wall framing for the structure and extends across at least two vertical frame members in the wall framing. The base members has a profile running laterally along the upper side thereof. The insulated metal panel is installed on the wall framing running horizontally across the vertical frame members and abutting the base member. The panel has a rigid foam core, an interior metal facing, and an exterior metal facing. The panel also has a profile running laterally along the lower side thereof. The upper profile of the base member and the lower profile of the panel are adapted to allow the base member and the panel to be joined by a tongue-in-groove joint running horizontally across the wall framing.

26 Claims, 9 Drawing Sheets

(56) References Cited

U.S. PATENT DOCUMENTS

2006/0254171 A1* 11/2006 Bostock ..... 52/392
2012/0240512 A1* 9/2012 Ting ..... 52/745.13

OTHER PUBLICATIONS

Green Span Profiles, *Insulated Metal Panel Installation Guide* (Version 1.0 May 31, 2012).
Green Span Profiles, *Stucco Technical Data Sheet*.
Green Span Profiles, Various Horizontal Installation Drawings (Sep. 2013).
Hazeleger, W. et al., *Darkling Beetles* (*Alphitobuis diaperinus*) *and Their Larvae as Vectors for the Transfer of Campylobacter jejuni and Salmonella enterica Serovar Paratyphi B Variant Java Between Successive Broiler Flocks*, 72 Applied and Environmental Microbiology (No. 22) p. 6887-6891 (Nov. 2008).
Kingspan, *200 Inverted Rib Insulated Metal Panels* (http://kingspanpanels.us/products/commercial-industrial/insulated-metal-wall-panels/200-inverted-rib).
MBCI, *Eco-Ficient Classic* (http://mbci.com/eClassic.html).
Metal Construction Association, *Environmental Product Declaration Insulated Metal Panels Wall and Roof Panel Systems* (Aug. 27, 2013).
Metal Construction Association, *Selection Guideline for Insulated Metal Panels* (Copyright 2010).
Metl Span, *CF Mesa & Light Mesa Insulated Metal Wall Panel*.

* cited by examiner

HORIZONTALLY ORIENTED INSULATED METAL PANEL SIDING SYSTEM

FIELD OF THE INVENTION

The present invention relates to insulated metal panels and, more particularly, to siding systems in which insulated metal panels are installed running horizontally across wall framing for a building.

BACKGROUND OF THE INVENTION

There are a wide variety of metal covers that have been used in the construction industry to provide a building's outermost barrier to wind and water. They may be manufactured to resemble wood shake, slate, shingles, clay tiles or other non-metallic cover materials and may be installed on exterior walls or on roofs. Metal covers can provide excellent weather resistance and durability.

One common type of metal covering utilizes insulated metal panels. The panels typically have a relatively thick insulating core sandwiched between thin metal interior and exterior facings. The insulating core most commonly is a rigid foam such as polyisocyanurate, polyurethane, and extruded and expanded polystyrene foams. The metal facing may be made of various metals, such as coated steel and aluminum, and usually is prefinished. They typically are formed by a continuous, foamed-in-place manufacturing process that binds the metal facings to the foam core.

The panels may be installed in any length, but typically are rather elongated, often being installed in lengths up to 40 feet or longer. They commonly will be from 24 to 42 inches wide and from 2 to 6 inches thick. The lateral sides of the panels are provided with profiles so that the panels may be joined along adjacent sides by interlocking seams or joints. When insulated metal panels are used to provide roof covers, the lateral sides of the panels may be configured in various way, for example, to provide a standing seam, high rib, or tongue-in-groove seam between adjacent panels. When they are used as wall siding, however, the lateral sides of insulated metal panels most commonly will have mating profiles which allow adjacent panels to be joined along their sides by a tongue-in-groove joint.

An insulated metal panel siding system will incorporate various flashings, trim pieces, sealants, and other components where the field of a wall terminates, such as at the top and bottom of a wall, corners, and around doors and windows. Even where a building has many intersecting walls, doors, windows, and the like, however, the basic construction of insulated metal panel siding systems over the expanse of the walls is fairly standard. The panels will be mounted on the wall framing of the building or other structure by various clips and fasteners. They most commonly are installed vertically, that is, the length of the panel will run vertically across the wall framing. Insulated metal panels, however, also are installed horizontally, that is, with the length of the panel running horizontally across the wall framing.

Clips typically will be used to secure one side of the insulated metal panel to a frame member. For vertical installations, it usually will be mounted to horizontal frame members, such as a wall girt. When the panels are installed horizontally, they most commonly will be mounted on vertical frame members, such as a post or stud. In either event, clips will be used to secure one side of the panel to a frame member, and the other side of the panel will be joined to an adjacent panel by a tongue-in-groove joint. The abutting side of the adjacent panel will be secured by a clip, thus both sides of the panel are secured to the wall framing.

Such prior art insulated metal panel siding systems are illustrated in FIGS. 1-6. As seen in FIGS. 1-2, prior art panel 20 has a rigid, foam core 21 sandwiched between an exterior metal facing 22*a* and an interior metal facing 22*b*. One or both facings 22 typically are embossed with decorative features, or are provided with various ridges, but are illustrated in the figures as flat unadorned surfaces for the sake of simplicity. The upper lateral side 23 and lower lateral side 24 of panel 20 are provided with mating profiles. More specifically, upper profile 23 defines a lower, outer tongue 25*a* and an upper, inner tongue 25*b*. Conversely, lower profile 24 defines a lower, outer groove 26*a* and an upper, inner groove 26*b*.

FIGS. 3-4 show two adjacent panels 20 installed horizontally on a vertically oriented post 12. As seen therein, the upper profile 23 of lower panel 20*a* is mounted on post 12 by fasteners, such as screws 27 which pass through a clip 28 positioned on upper profile 23 and extend into post 12. The upper side 23 of lower panel 20*a* thus secured, the tongue-in-groove joint provided between lower panel 20*a* and upper panel 20*b* will secure the lower side 24 of upper panel 20*b*. The upper side 23 of upper panel 20*b* (not shown) will be secured to post 12 by additional clips 28 and screws 27. Sealant beads, such as beads 29, usually also are provided.

When insulated metal panels are installed horizontally, the panels typically will be installed from the bottom up. That is, a first panel is installed near the base of the wall framing. FIGS. 5-6 show a typical prior art installation of the first, lowermost panel. Successive panels then will be installed above the first panel as shown in FIGS. 3-4 until the siding is fully installed across the wall.

As shown in FIGS. 5-6, asymmetrical U-shaped base clips 30 are used to secure the lower end 24 of a first, lowermost panel 20*a*. Base clips 30 are elongated, and are installed end to end near and along the base of the wall framing, typically proximate the vertical frame members in the wall framing, such as post 12. Viewed in cross-section, as shown in FIG. 5, base clips 30 have an asymmetrical U-shape, the outer side thereof being shorter than the inner side. An elongated trim piece, such as a base trim 31, which extends across the vertical frame members usually is installed at the same time.

For example, as seen in FIGS. 5-6, base clip 30 and base trim 31 are mounted proximate to the bottom of post 12 which forms part of a wall frame 11. More specifically, fasteners, such as screws 37 are driven through base clip 30 and base trim 31 and into post 12. Base clip 30, however, may be attached to other wall frame members as may be present in a wall framing, such as horizontal frame members, or to the foundation 13, either directly or indirectly. For example, base clips may be attached to the foundation by fasteners extending into the foundation or indirectly via a base angle running along the base of the wall framing.

In any event, it will be appreciated that base clip 30 is configured such that the outer, shorter side of clip 30 extends into lower, outer groove 26*a* in lower profile 24 of lowermost panel 20*a*. The lower side 24 of panel 20*a*, therefore, is connected and supported proximate to post 12. The upper side 23 will be secured to post 12, for example, with screws 27 and clips 28 as shown in FIGS. 3-4. Additional trim typically is installed, such as cover trim 32, with fasteners 36. Sealant beads usually are provided as well, such as sealant bead 38 running between base trim 31 and inner facing 22*b* of panel 22*a* and sealant bead 39 running between base trim 31 and foundation 13. Other sealant beads and flashing may be provided to further weather proof the connection between frame 11 and the lower portion of panel 20*a*. Once the first panel 20*a* is installed, additional panels 20 will be installed successively above it, for example, as shown in FIGS. 3-4.

Such insulated metal panel siding systems and installations offer significant advantages over other siding systems. Insulated metal panels provide significant structural support and generally reduce the amount of framing required. Large areas also may be covered with relatively few panels, and the panels may be installed with relatively few additional components and fasteners. Installation, therefore, may proceed more quickly and with less labor costs than other siding systems. The various clips and trim pieces typically are fabricated from steel, aluminum, or other metals. Thus, they are strong and lightweight, and may be easily fabricated by roll formers and metal stamps in a variety of configurations to further simplify installation.

When conventional metal base clips are used, however, certain issues may present themselves. For example, once the upper side of a panel is mounted to the wall frame, conventional metal base clips may allow the lower part of the bottom panel to flare out and away from the building frame. That flaring may make it more difficult to seal around the bottom of the panel, and in any event can make the panel appear out of plumb.

Because of the structural integrity of insulated metal panels, the vertical frame members to which the panels are mounted may by relatively widely spaced. For example, in a post and beam frame, the columns may be spaced 4 to 8 feet apart. When the spacing is relatively wide, however, there is a tendency for panels to bow or puff out between the panels as a result of thermal deflection.

When insulated metal panels are installed they also have a visible joint gap. Ideally, the panels are leveled so that the joint gap appears to the eye to be perfectly horizontal. Especially in longer lengths, however, the panels may weigh as much as 250 pounds. The weight and bulk of the panels makes it more difficult to ensure that they are installed on level.

Flashing and sealant beads may be provided between the base clip, the bottom panel, and the wall frame so as to provide a moisture barrier. Typically, however, weep holes are provided in the base clip to allow collected moisture to drip out. Thus, insects in their larval stage, such as the larder beetle (*Dermestes lardarius*) and other *Dermestidae* beetles (commonly known as hide beetles) are able to access the foam core of the bottom panel and are known to burrow into the foam. Such burrowing in time will a degrade and weaken the panel. Such problems are particularly acute in poultry, pork, and other animal containment facilities, insofar as the mature beetle may lay eggs in manure. Such insects also may act as vectors transmitting disease to animals sheltered in a building, such as the transmission of salmonella and campylobacter to poultry.

The statements in this section are intended to provide background information related to the invention disclosed and claimed herein. Such information may or may not constitute prior art. It will be appreciated from the foregoing, however, that there remains a need for new and improved siding systems utilizing horizontally installed insulated metal panels and methods for installing insulated metal panels horizontally across a wall frame. Such disadvantages and others inherent in the prior art are addressed by various aspects and embodiments of the subject invention.

SUMMARY OF THE INVENTION

The subject invention relates generally to siding systems in which insulated metal panels are installed running horizontally across wall framing for a building and encompasses various embodiments and aspects, some of which are specifically described and illustrated herein. One aspect of the invention provides for an insulated metal panel siding system for a structure which comprises elongated base members and elongated insulated metal panels. The base member is installed along the base of wall framing for the structure and extends across at least two vertical frame members in the wall framing. The base members has a profile running laterally along the upper side thereof. The insulated metal panel is installed on the wall framing running horizontally across the vertical frame members and abutting the base member. The panel has a rigid foam core, an interior metal facing, and an exterior metal facing. The panel also has a profile running laterally along the lower side thereof. The upper profile of the base member and the lower profile of the panel are adapted to allow the base member and the panel to be joined by a tongue-in-groove joint running horizontally across the wall framing.

Other aspects provide such siding systems where the upper profile of the base member covers exposed portions of the foam core in the lower side of the panel. Additional aspects and embodiments provide such siding systems where the base member has a thickness equal to the thickness of the panel and the upper profile of the base member and the lower profile of the panel abut continuously across the profiles.

Another embodiment provides such siding systems where the panel has an upper profile running laterally along the upper side thereof and wherein the upper profile of the panel and the upper profile of the base member are the same.

Yet another aspect and embodiment provides such siding systems comprising a plurality of the panels installed on the wall framing. The panels run horizontally across the wall framing and abut along adjacent sides thereof. Each panel has the lower profile in the lower side thereof and an upper profile in the upper side thereof. The lower and upper panel profiles are adapted to allow adjacent the panels to be joined by tongue-in-groove joints running horizontally across the wall framing between abutting the upper and lower panel sides.

Various other aspects provide such siding systems where the lower and upper panel profiles provide a plurality of tongue-in-groove joints between abutting the upper and lower panel sides. Other aspects provide such siding systems where the upper profile of the base member has at least one tongue and the lower profile of the panel has at least one groove mating with the tongue or where the upper profile of the base member has a pair of tongues and the lower profile of the panel has a pair of grooves mating with the tongues.

Yet other embodiments of the subject invention provide such siding systems where the base member is fabricated from wood, such as treated wood.

Another aspect provides for such siding systems where the tongue-in-groove joint between the base member and the panel is provided with a sealant, such as where the sealant is provided at the top of the tongues in the tongue-in-groove joint.

Still other embodiments provide such siding systems where the base member is mounted on vertical frame members provided in the wall framing by fasteners extending through the base member into the vertical frame members.

Further aspects and embodiments provide such siding systems where the panel is mounted on vertical frame members provided in the wall framing by fasteners extending through a clip and the panel into the vertical frame members.

The subject invention also encompasses methods for installing insulated metal panel siding systems. Such embodiments include methods where insulated metal panels are installed to provide siding for a structure by installing an elongated base member and installing a first insulated metal panel. The base member is installed across vertical frame members in wall framing for the structure at the base thereof and has a profile running laterally along the upper side thereof. The first insulated metal panel is installed across the frame members and above the base member. The panel has a profile running laterally along the lower side thereof. The panel is installed such that the panel runs horizontally across the wall framing with its the lower profile mating with the upper profile of the base member to provide a tongue-in-groove joint between the base member and the first panel.

Other aspects and embodiments provide such methods where the first panel has an upper profile running laterally along the upper side thereof and the method comprises installing a second insulated metal panel across the frame members and above the first panel. The second panel has a lower profile running laterally along the lower side of the second panel. The second panel is installed such that the second panel runs horizontally across the wall framing with its the lower profile mating with the upper profile of the first panel to provide a tongue-in-groove joint between the first panel and the second panel.

Further embodiments provide such methods where the upper profile of the base member covers exposed portions of the foam core in the lower side of the panel.

Another aspect provides such methods where the base member has a thickness equal to the thickness of the panel and the upper profile of the base member and the lower profile of the panel abut continuously across the profiles.

Still other embodiments provide such methods where the upper profile of the first panel and the upper profile of the base member are the same.

Finally, still other aspect and embodiments of the invention will provide siding systems and methods of installing siding systems that will encompass various combinations of such features as will be apparent to workers in the art.

Thus, the present invention in its various aspects and embodiments comprises a combination of features and characteristics that are directed to overcoming various shortcomings of the prior art. The various features and characteristics described above, as well as other features and characteristics, will be readily apparent to those skilled in the art upon reading the following detailed description of the preferred embodiments and by reference to the appended drawings.

Since the description and drawings that follow are directed to particular embodiments, however, they shall not be understood as limiting the scope of the invention. They are included to provide a better understanding of the invention and the manner in which it may be practiced. The subject invention encompasses other embodiments consistent with the claims set forth herein.

Figure 1:
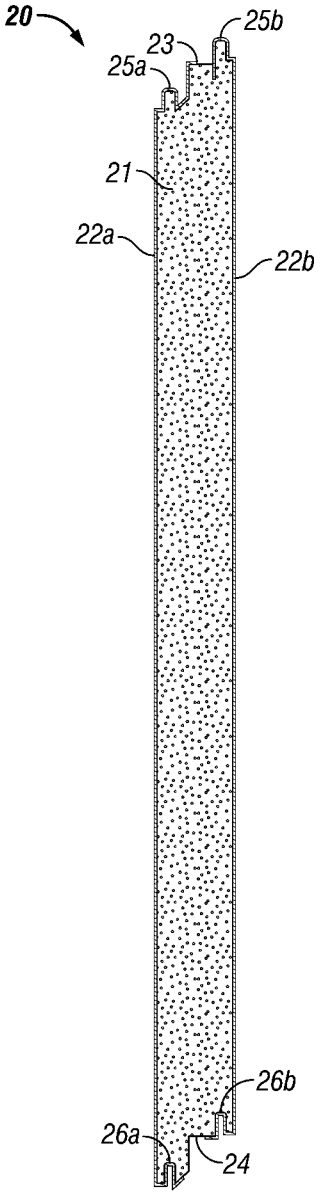
FIG. 1 (Prior Art)
FIG. 1 (prior art) is an end view of a prior art insulated metal panel 20 used in novel siding system 10, which view in particular shows the profiles provided in the upper side 23 and lower side 24 of panel 20.

In the drawings and description that follows, like parts are identified by the same reference numerals. The drawing figures are not necessarily to scale. In some drawings certain components that normally would be drawn together are shown with slight spacing so that the separate components may be visualized more easily. Certain features of the embodiments also may be shown exaggerated in scale or in somewhat schematic form and some details of conventional design and construction may not be shown in the interest of clarity and conciseness.

DESCRIPTION OF ILLUSTRATIVE EMBODIMENTS

The subject invention relates generally to siding systems, and buildings and other structures incorporating siding systems in which insulated metal panels are installed running horizontally across wall framing for the structure. Broader embodiments of the siding systems comprise an elongated base member that is used to install the lowermost insulated metal panel in a horizontal installation. The base member is installed along the base of wall framing of the building. It extends across at least two vertical frame members in the wall framing, but preferably extends across the expanse of the wall framing. The base member is provided with a profile running laterally along its upper side. The upper profile of the base member and the lower profile of the insulated metal panel are coordinated so that the base member and the panel may be joined by a tongue-in-groove joint running horizontally across the wall framing.

Figure 2A:
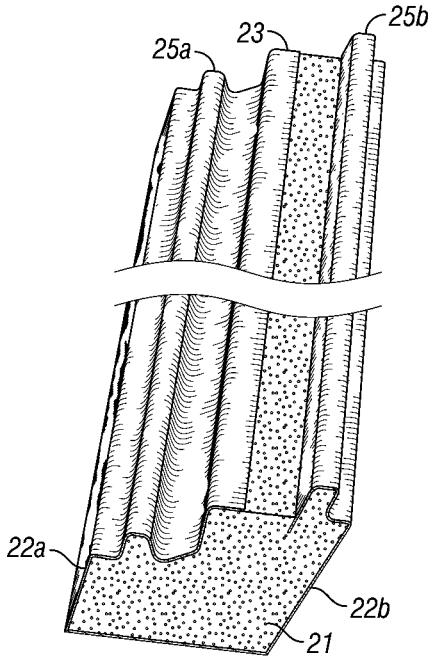
FIG. 2A (prior art) is a perspective view of a top corner portion of panel 20 shown in FIG. 1 showing the profiled upper side 23 of panel 20.
Figure 2B:
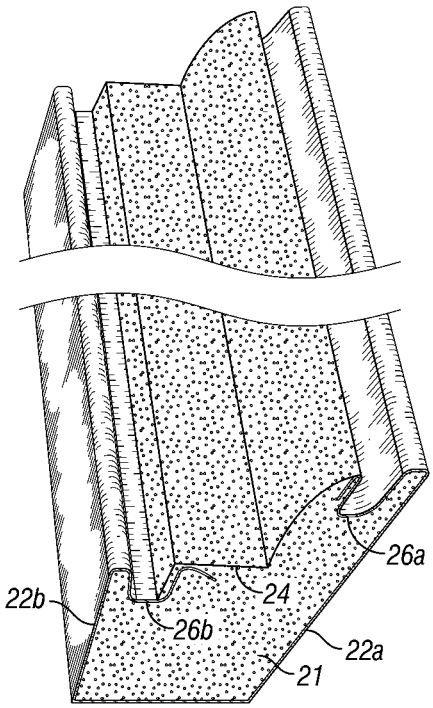
FIG. 2B (prior art) is a perspective view of a bottom corner portion of panel 20 shown in FIG. 1 showing the profiled lower side 24 of panel 20.
Figure 3:
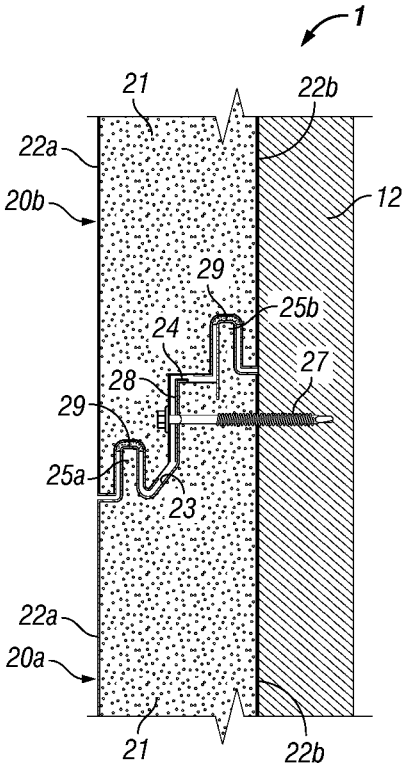
FIG. 3 (Prior Art)
FIG. 3 (prior art) is a cross-sectional view taken generally along a vertical plane of a prior art insulated metal panel siding system 1 in which panels 20 are installed horizontally showing the tongue-in-groove seam joint joining panels 20.
Figure 4:
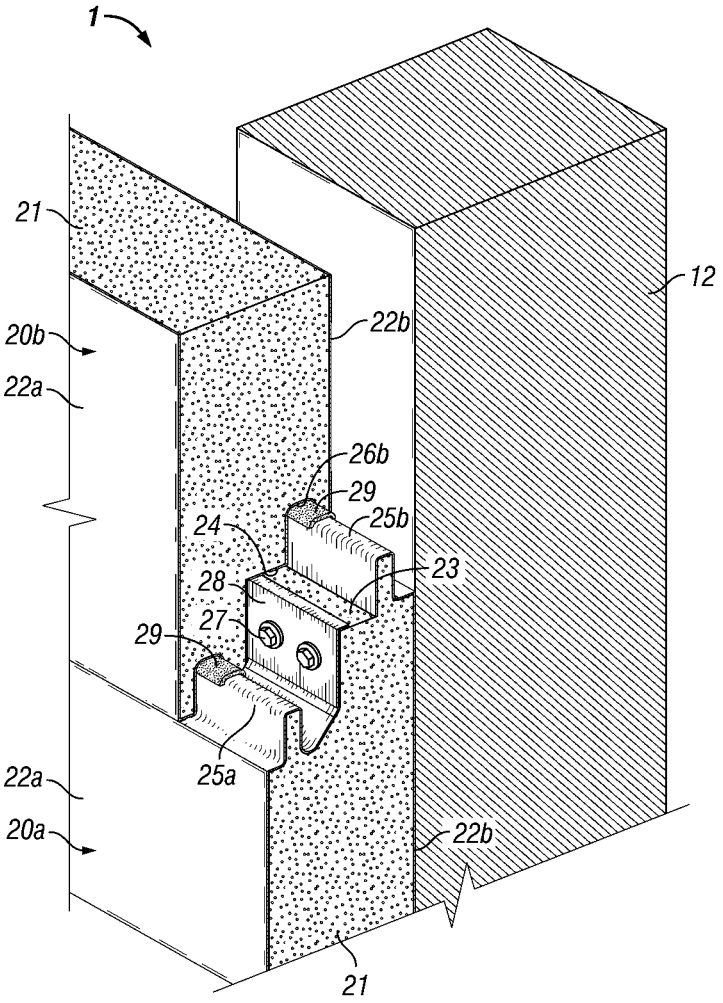
FIG. 4 (Prior Art)
FIG. 4 (prior art) is a partial tear-away, perspective view of the joined panels 20 shown in FIG. 3.

For example, a preferred siding system 10 shown in FIGS. 7-10 comprises panels 20 and base member 40. As seen in FIGS. 1-2, panels 20 in siding system 10 have a rigid, foam core 21 sandwiched between metal facings 22. Their upper lateral side 23 is profiled to provide lower, outer tongue 25*a* and upper, inner tongue 25*b*. Their lower lateral side 24 is profiled to provide lower, outer groove 26*a* and upper, inner groove 26*b*. As shown in FIGS. 3-4, upper profile 23 and lower profile 24 are configured to allow abutting panels 20 to mate and be joined by a double tongue-in-groove joint. It also will be noted, as seen best in FIG. 2, that both exterior metal facing 22*a* and interior metal facing 22*b* wrap around partially into, but not completely through upper profile 23 and lower profile 24. Thus, upper profile 23 and lower profile 24 both have areas where foam core 21 is exposed.

Figure 7:
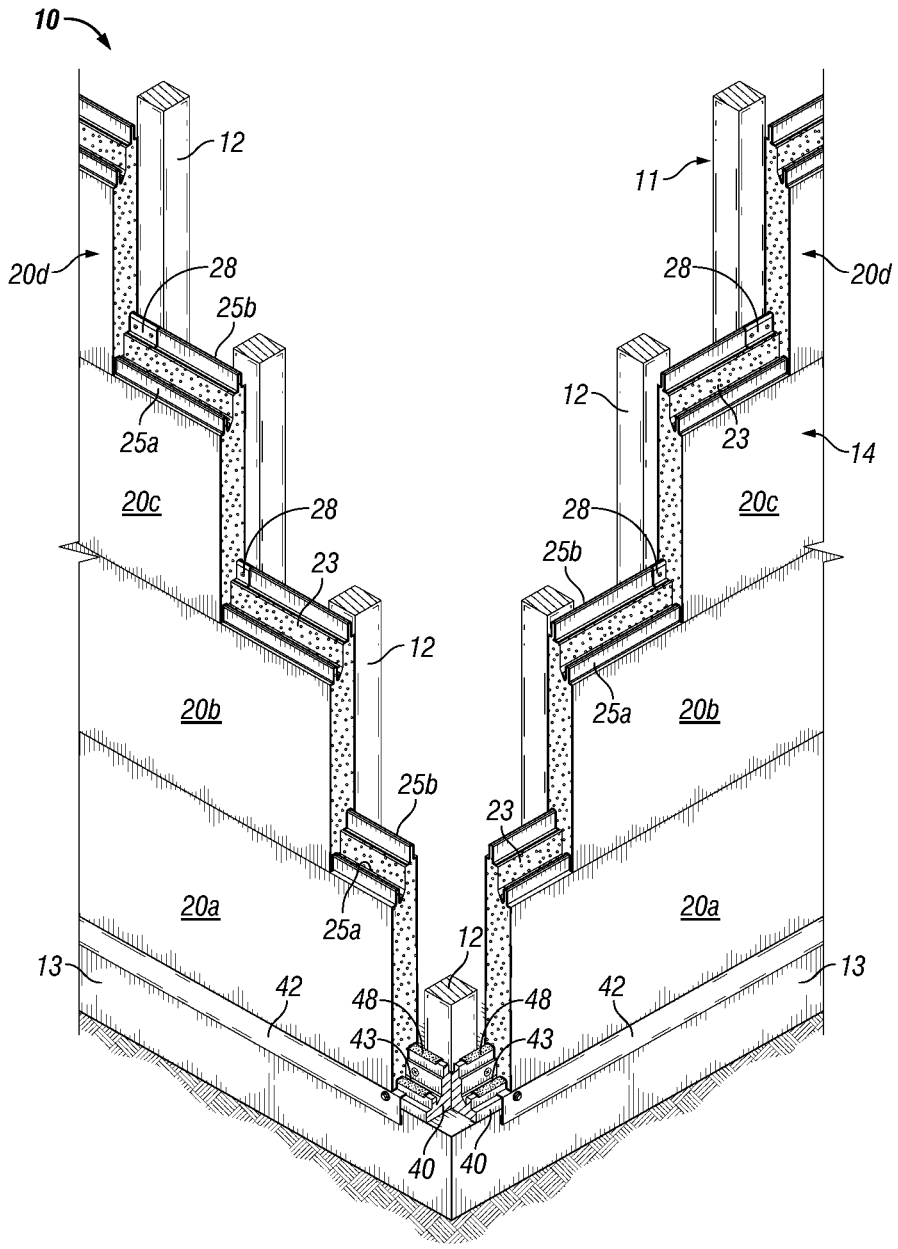
FIG. 7 is a perspective view, including partial tear-away views, of a preferred embodiment 10 of the novel insulated metal panel siding systems.

As best seen in FIG. 7, panels 20 in siding system 10 are installed on wall framing 11 of structure 14. Structure 14 has a conventional post and beam frame, thus wall framing 11 comprises an array of vertical support members, such as wooden posts 12, which are joined at their upper ends by horizontal beams (not shown). It also will be noted that in FIG. 7 posts 12 are illustrated as being relatively closely spaced. That is for convenience. More commonly, posts 12 will be widely spaced, for example, at spacing of 4 to 8 feet.

Panels 20 are installed horizontally across the array of posts 12 in wall framing 11. By horizontal, it will be understood that panels 20 are installed such that the length of panels 20 extends horizontally across the field of the wall, as opposed to running vertically or up-and-down across the field. Preferably, individual panels 20 are long enough to extend across the entire length of the wall, but the length may be covered by panels abutting at their ends or abutting with other types of siding.

Siding system 10 may be installed across wall frame 11 by first installing an elongated base member, such as base member 40, proximate to the base or lower boundary of wall frame 11. Base member 40 extends across posts 12 in wall frame 11. As will be better appreciated from the description that follows, base member 40 preferably extends continuously along the entire base of wall frame 11. Depending on the length of wall frame 11, however, base member 40 may be installed in separate lengths.

Figure 8:
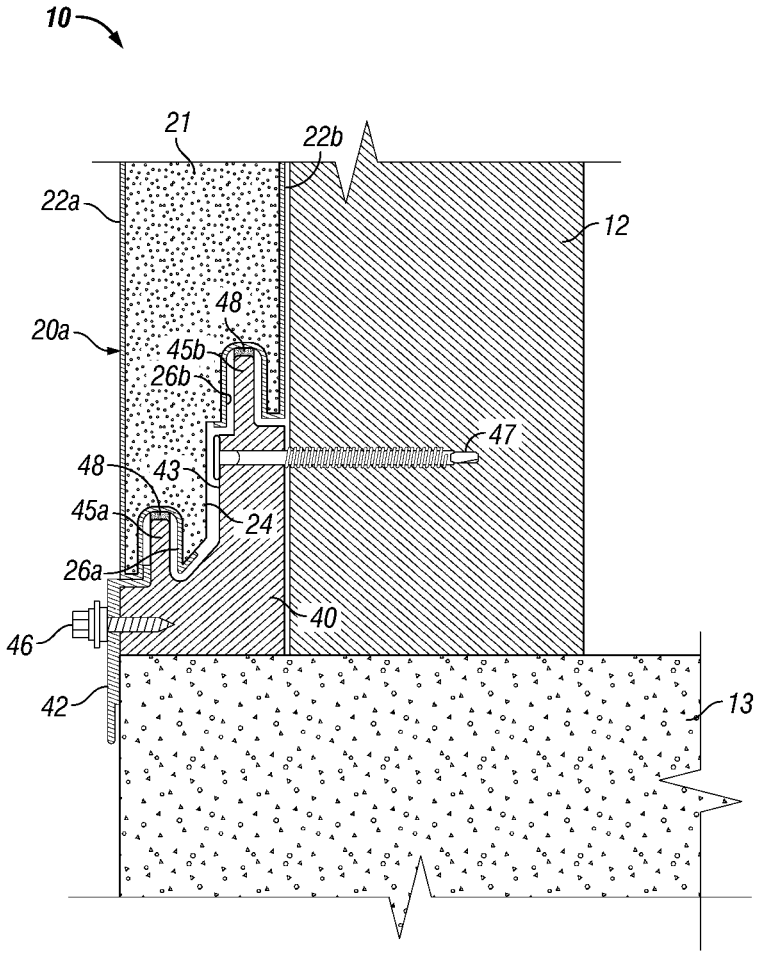
FIG. 8 is a cross-sectional view similar to the view of FIG. 5 showing the installation of the lower most insulated metal panel 20 in novel siding system 10.
Figure 9:
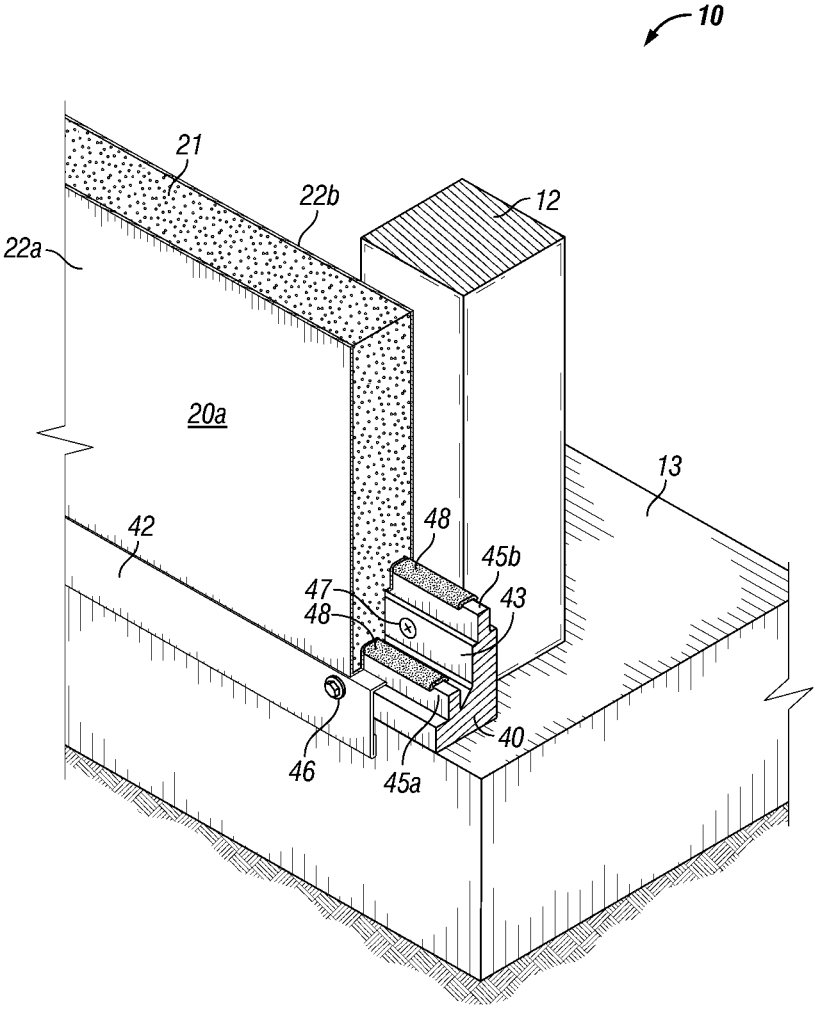
FIG. 9 is a partial tear-away, perspective view of the installation of the novel siding system 10 shown in FIG. 8.

As best appreciated from FIGS. 8-9, base member 40 is mounted to posts 12 near the lower end of posts 12. More specifically, fasteners, such as screws 47 are driven through base member 40 into posts 12. Base member 40, however, may be attached to other wall frame members as may be provided in a wall framing, such as horizontal frame members, or to the foundation 13, either directly or indirectly. For example, base member 40 may be attached to foundation 13 by fasteners extending into foundation 13 or indirectly via base angles (not shown) installed along the base of wall framing 11.

As seen best in FIGS. 8-9, base member 40 has a generally flat bottom surface, a shorter outer face, and a taller inner face. The upper side 43 of base member 40 extends between the upper edges of the outer and inner faces and is profiled. Profile 43 defines an outer tongue 45*a* and an inner tongue 45*b*. Tongues 45 defined in profile 43 run laterally, that is, they run along the length of base 40.

Base 40 is adapted to support the lowermost panel 20*a* and to secure its lower side 24. Thus, upper profile 43 of base member 40 is configured to mate with lower profile 24 of lowermost panel 20*a* such that base member 40 and panel 20*a* are joined by a tongue-in-groove joint running horizontally across wall framing 11. More particularly, it will be noted that when mated, base member 40 and panel 20*a* are joined by pair of tongue-in-groove joints, outer tongue 45*a* on profile 43 extending into outer groove 26*a* on lower profile 24 of panel 20*a* and inner tongue 45*b* on profile 43 extending into inner groove 26*b* on lower profile 24 of panel 20*a*. It will be noted that upper profile 43 of base member 40 preferably is substantially identical to upper profile 23 of panels 20. Lowermost panel 20*a*, therefore, may be the same as panels 20 installed higher up on the wall.

As shown in FIGS. 8-9, a cover trim 42 may be installed to enhance the appearance and weather tightness of siding system 10. Cover trim 42 typically is an angled, lightweight metal or plastic trim that extends extending along the length of base member 40 around its outer, upper corner. It may be secured to base member 40 by fasteners, such as screws 46. Sealants, such as sealant beads 48 running along the top of tongues 45 on upper profile 43, also are provided between base member 40 and lowermost panel 20*a*. Sealant beads 48 may be any conventional sealant, such as a non-skinning butyl sealant. Sealant beads 48 may be applied to panels 20 in the factory during manufacture, or they may be applied in the field as panels 20 are installed.

In any event, as appreciated from FIG. 7, lowermost panel 20*a* may be installed over wall frame 11 by first situating its lower profile 24 over upper profile 43 of base member 40. The tongue-in-groove joints thus formed between base member 40 and panel 20*a* will secure the lower end of panel 20*a* to wall frame 11. Once the lower end of panel 20*a* is thus secured, upper side 23 of panel 20*a* will be secured to wall frame 11. More specifically, as shown in FIGS. 3-4, upper side 23 of panel 20*a* will be mounted to posts 12 by a series of screws 27 and clips 28. The next panel 20*b* then will be situated such that its lower profile 24 engages the upper profile 23 of lowermost panel 23*a*, thus securing its lower end on wall frame 11. The upper side 23 of panel 20*b* will be secured to posts 12 with screws 27 and clips 28 as described above, after which additional panels 20 will be installed in succession until the wall framing 11 is completely sided.

Figure 10:
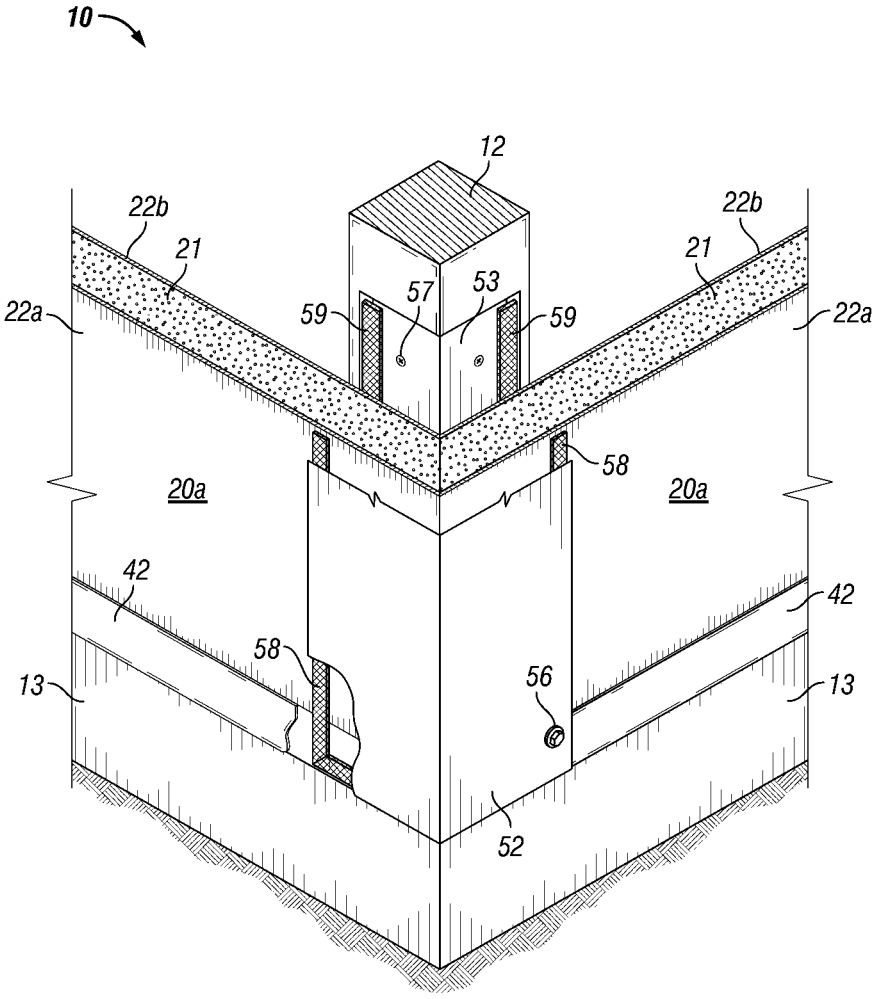
FIG. 10 is a partial tear-away, perspective view showing the installation of the lower most insulated metal panel 20 in a corner area of the novel siding system 10.

The transition areas of the novel siding systems, that is, the areas where the panels abut or terminate into another field or with other features of a structure, such as corners, windows, doors, eaves and the like, may be installed and finished in a manner similar to conventional siding systems. Many such methods of installing and finishing siding systems in transition areas are known. The ends or sides of panels may be attached to frame members in such areas by, e.g., through-panel screws and other fasteners. A variety of conventional clips also may be employed. Conventional trims, flashings, and sealants may be used, and voids in such transitional areas typically will be provided with expanding foam or other insulating materials.

Where fields of siding system 11 intersect at outside or inside corners they may be finished with butt or mitered joints. As illustrated in FIG. 10, for example, an outside corner between intersecting fields of siding system 10 may be formed with a mitered joint between intersecting panels 20*a* and base members 40 (not shown). Exterior corner trim 52 and interior corner flashing 53 may be installed with fasteners, such as screws 56 and 57. Sealant beads, such as beads 58 and 59 may be provided, respectively, between corner trim 52 and panels 20 and between corner flashing 53 and panels 20 to provide greater weather resistance to the corner. An inside corner may be finished in a similar fashion.

It will be appreciated that the base members preferably will provide continuous support along the entire lower side of the lowermost panels in the siding. For example, base member 40 in siding system 10 preferably extends in one or more pieces continuously along the entire base of wall frame 11 and around the base of other walls in the structure. The thickness of base member 40 also is equal, that is, substantially equal to the thickness of panels 20. Thus, the lower portions of siding system 10 have a neat, finished appearance, and upper profile 43 of base member 40 abuts lower profile 24 of panel 20*a* in a continuous, that is, substantially continuous fashion.

Some play between base member 40 upper profile 43 and panel 20*a* lower profile 24 is inevitable given manufacturing tolerances. An expansion gap also typically will be provided between the top of tongues 45 and the depth of grooves 26 as is common in tongue-in-groove joints. In this regard, it will be noted that FIG. 8 shows slight gaps between lower panel 20*a*, base member 40, and post 12. That slight spacing is provided in the figure so that the separate components may be visualized more easily. Workers in the art will appreciate that they will be drawn together upon installation.

Otherwise, base member 40 is able to provide tight, substantially continuous support for lowermost panel 20*a* along its entire length. Lowermost panels 20*a*, therefore are reinforced and less susceptible to flaring out away from wall framing 11. Panels 20, and especially lowermost panel 20*a*, also are more resistant to bowing outward between posts 12, even when posts 12 are spaced relatively widely.

It also will be appreciated that the base members may make it easier to install the panels on level. Insulated metal panels, for example, may be quite heavy and unwieldy, and installers may find it difficult to ensure that the lowermost panel does not dip toward one end of the wall or the other. Base member 40, for example, is more easily handled than panels 20*a* and may be more easily installed on level. Once installed, it is able to provide sufficient support to ensure that panel 20*a* and the other panels 20 installed above it are on level.

Perhaps more importantly, however, the novel siding systems may provide greater protection against damage from *Dermestidae* beetles and other insects that may burrow into the foam core of insulated metal panels. That is, insulated metal panels typically are formed by a continuous, foamed-in-place manufacturing process that roll forms the metal facing of the panels. The exterior and interior metal facings wrap partially around and into the profiled panel sides. The metal facings, however, do not extend completely across the panels sides. Portions of the foam core are exposed or are covered by relatively thin plastic films and when installed can be accessed and damaged by certain insects.

Figure 5:
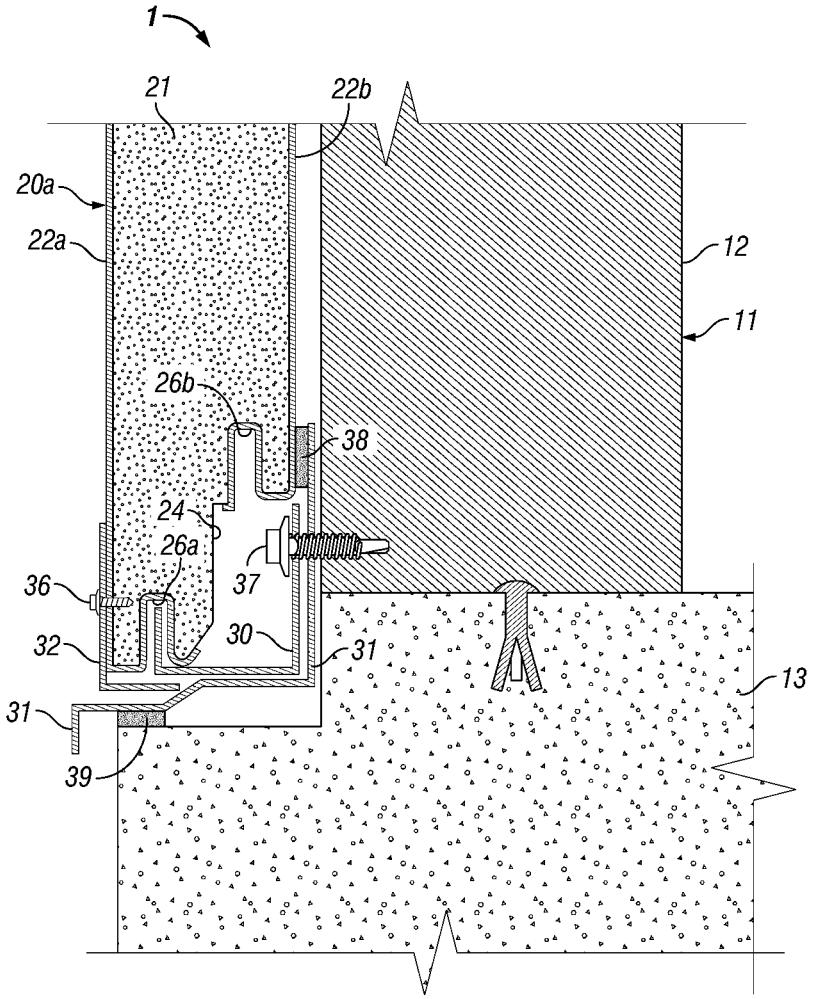
FIG. 5 (Prior Art)
FIG. 5 is a cross-sectional view of prior art siding system 1 similar to the view of FIG. 3 showing installation of the lower most insulated metal panel 20.
Figure 6:
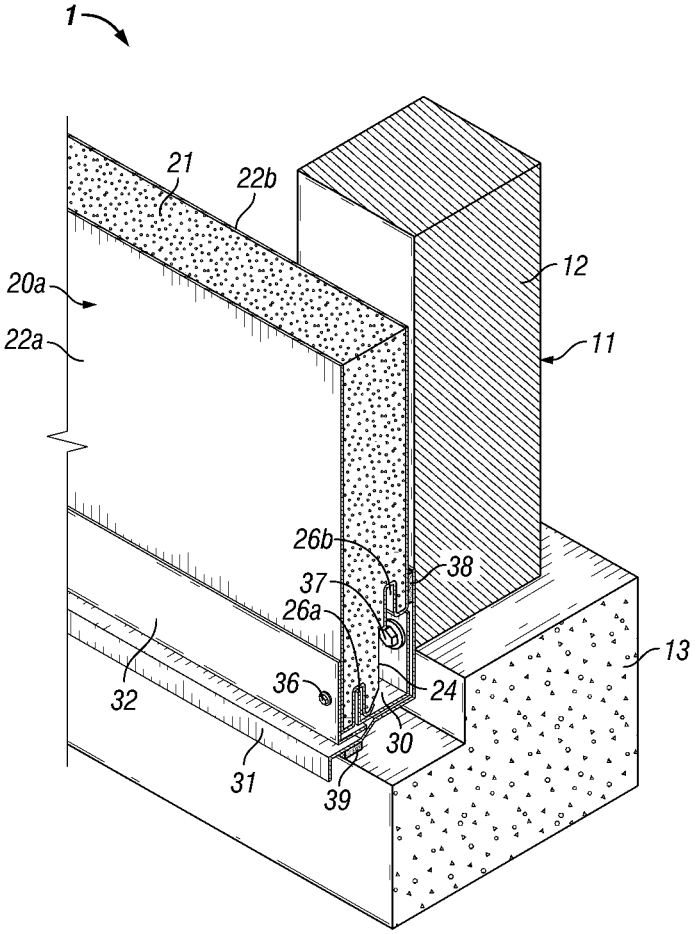
FIG. 6 (Prior Art)
FIG. 6 (prior art) is a partial tear-away, perspective view of the installation shown in FIG. 5.

For example, and as best appreciated from FIGS. 4-5, in conventional siding system 1 the exposed portions of foam core 21 on lower profile 24 of panel 20*a* may be easily accessed by insects. In siding system 10, however, it will be noted that base member 40 will isolate or cover the exposed portions of foam core 21 on lower profile 24 of panel 20*a*. Profile 43 on base member 40 continuously abuts lower profile 24 of panel 20*a*, and that abutment will significantly restrict access to foam core 21 by insects. Sealant beads 48 provided on tongues 45 of base member 40 further isolate exposed portions of foam core 21. To the extent that insects are discouraged from sheltering within the foam core of panels, the risk that they will transmit pathogens to livestock sheltered in a building also may be diminished.

Panels 20 and other insulated metal panels which may be used in the novel siding systems typically will have polyisocyanurate, polyurethane, and extruded and expanded polystyrene foam cores. The metal facings typically will be fabricated from coated steel, such as G90 galvanized (A653) steel, and AZ 50 aluminum-zinc alloy coated (A792) steel, and aluminum, in 22 to 26 gauge thicknesses. The metal facings most commonly will be prefinished on both the interior and exterior faces. Exterior finishes include polyvinylidene fluoride coatings such as a 70% Kynar® 500/Hylar® 5000 coating or a silicone modified polyester paint. Interior finishes most typically are a standard polyester paint.

Similarly, the profiles shown in the illustrated panels 20 allow panels 20 to be easily and effectively joined by a tongue-in-groove joint. Panels having other profiles, however, may be used if desired in the novel siding systems to provide a joint between adjacent panels. Many such panels with a variety of profiles are known and commercially available, such as CF Mesa and other panels available from Metl Span, Eco-ficient Classic and other panels available from MBCI, Versawall and other panels available from Centria, and 200 Inverted Rib and other panels available from the Kingspan Group.

The base member of the novel siding systems may be fabricated from various materials. Base member 40, for example, may be fabricated from wood, such a milled Southern Pine, Douglas Fir, or other woods used for dimensional lumber. Preferably, the wood will be treated to enhance its resistance to rot and insect damage. Most commonly, such wood would be pressure treated with various well known copper and boron compounds. Wood treated with creosote and other oil based preservatives, however, may be used as appropriate.

Base members fabricated from wood are preferred. They provide good support and may be manufactured easily and economically by numerous and usually local lumber mills. Other materials, however, may be used. For example, base members may be fabricated from extruded or molded plastics, such as extruded polyvinyl chloride and molded polypropylene. Similarly, they may be fabricated from cast, extruded or formed metal, such as extruded aluminum. Such base members may be solid or may be tubular or channeled to reduce weight and expense. For example, steel and other sheet metals may be roll formed into a generally U-shaped configuration with the base of the "U" being shaped to provide the desired upper profile. Aluminum may be extruded with such profiles.

Novel siding system 10 also has been exemplified in the context of a typical post and beam framing system. It will be appreciated, however, that siding system 10 and other embodiments of the novel siding systems may be installed on buildings having other types of frames, such as balloon framing and platform framing. Such frames may be assembled from dimensional lumber or from light (cold formed) steel members. They also may be installed on heavier steel frames, such as clearspan, modular, or single slope frames.

While this invention has been disclosed and discussed primarily in terms of specific embodiments thereof, it is not intended to be limited thereto. Other modifications and embodiments will be apparent to the worker in the art.

What is claimed is:

1. An insulated metal panel siding system for a structure, said structure having a frame including wall framing, said wall framing having a base and including vertical frame members, said siding system comprising:

(a) an elongated base member installed proximate said base of said wall framing for said structure and extending across at least two said vertical frame members in said wall framing, said base member having a profile running laterally along the upper side thereof; and (b) an elongated insulated metal panel installed on said wall framing, said panel running horizontally across said vertical frame members and abutting said base member, said panel having a rigid foam core, an interior metal facing, and an exterior metal facing, said panel having a profile running laterally along the lower side thereof;

(c) wherein said upper profiled side of said base member substantially continuously abuts said lower profiled side of said panel, said base member upper profiled side and said panel lower profiled side being adapted to allow said base member and said panel to be joined by a tongue-in-groove joint running horizontally across said wall framing.

2. The metal panel siding system of claim 1, wherein said upper profiled side of said base member covers exposed portions of said foam core in said lower profiled side of said panel.

3. The metal siding system of claim 2, wherein said base member has a thickness equal to the thickness of said panel and said upper profiled side of said base member and said lower profiled side of said panel abut continuously across said profiled sides.

4. The metal panel siding system of claim 2, wherein said base member is fabricated from wood.

5. The metal panel siding system of claim 1, wherein said base member has a thickness equal to the thickness of said panel and said upper profiled side of said base member and said lower profiled side of said panel abut continuously across said profiled sides.

6. The metal panel siding system of claim 5, wherein said base member is fabricated from wood.

7. The metal panel siding system of claim 1, wherein said panel has an upper profile running laterally along the upper side thereof and wherein said upper profile of said panel and said upper profile of said base member are the same.

8. The metal panel siding system of claim 7, wherein said base member is fabricated from wood.

9. The metal panel siding system of claim 1, wherein said siding system comprises a plurality of said panels installed on said wall framing, said panels running horizontally across said wall framing and abutting along adjacent sides thereof, each said panel having said lower profile in said lower side thereof and an upper profile in the upper side thereof, wherein said lower and upper panel profiled side are adapted to allow adjacent said panels to be joined by tongue-in-groove joints running horizontally across said wall framing between abutting said upper and lower panel sides.

10. The metal panel siding system of claim 9, wherein said lower and upper panel profiled sides provide a plurality of tongue-in-groove joints between abutting said upper and lower panel sides.

11. The metal panel siding system of claim 1, wherein said upper profiled side of said base member has at least one tongue and said lower profiled side of said panel has at least one groove mating with said tongue.

12. The metal panel siding system of claim 1, wherein said upper profiled side of said base member has a pair of tongues and said lower profiled side of said panel has a pair of grooves mating with said tongues.

13. The metal panel siding system of claim 1, wherein said base member is fabricated from wood.

14. The metal panel siding system of claim 1, wherein said base member is fabricated from treated wood.

15. The metal panel siding system of claim 1, wherein said tongue-in-groove joint between said base member and said panel is provided with a sealant.

16. The metal panel siding system of claim 1, wherein said sealant is provided at the top of the tongues in said tongue-in-groove joint.

17. The metal panel siding system of claim 1, wherein said base member is mounted on vertical frame members provided in said wall framing by fasteners extending through said base member into said vertical frame members.

18. The metal panel siding system of claim 1, wherein said panel is mounted on vertical frame members provided in said wall framing by fasteners extending through a clip and said panel into said vertical frame members.

19. A method of installing insulated metal panels to provide siding for a structure, said method comprising:

(a) installing an elongated base member across vertical frame members in wall framing for said structure at the base thereof, said base member having a profile running laterally along the upper side thereof;

(b) installing a first insulated metal panel across said frame members and above said base member, said panel having a profile running laterally along the lower side thereof, said panel being installed such that said panel runs horizontally across said wall framing with its said lower profiled side substantially continuously mating with said upper profiled side of said base member to provide a tongue-in-groove joint between said base member and said first panel.

20. The method of claim 19, wherein said first panel has an upper profile running laterally along the upper side thereof and said method comprises installing a second insulated metal panel across said frame members and above said first panel, said second panel having a lower profile running laterally along the lower side of said second panel, said second panel being installed such that said second panel runs horizontally across said wall framing with its said lower profiled side mating with said upper profiled side of said first panel to provide a tongue-in-groove joint between said first panel and said second panel.

21. The method of claim 20, wherein said first panel has an upper profile running laterally along the upper side thereof and said upper profile of said first panel and said upper profile of said base member are the same.

22. The method of claim 21, wherein said base member is fabricated from wood.

23. The method of claim 19, wherein said upper profiled side of said base member covers exposed portions of said foam core in said lower profiled side of said panel.

24. The method of claim 23, wherein said base member is fabricated from wood.

25. The method of claim 19, wherein said base member has a thickness equal to the thickness of said panel and said upper profiled side of said base member and said lower profiled side of said panel abut continuously across said profiled sides.

26. The method of claim 25, wherein said base member is fabricated from wood.

* * * * *